United States Patent [19]

Knobel

[11] 4,004,580

[45] Jan. 25, 1977

[54] VIBRATORY MASSAGE APPARATUS

[76] Inventor: David Knobel, Spittel 38, CH 8762 Schwanden, Switzerland

[22] Filed: Aug. 7, 1975

[21] Appl. No.: 602,894

[30] Foreign Application Priority Data

Aug. 7, 1974 Switzerland ..... 10798/74

[52] U.S. Cl. ..... 128/32; 128/63

[51] Int. Cl.[2] ..... A61H 1/00

[58] Field of Search ..... 128/32, 26, 63

[56] References Cited

UNITED STATES PATENTS

| | | | |
|---|---|---|---|
| 1,837,531 | 12/1931 | Cole | 128/63 |
| 2,088,963 | 8/1937 | Kondo | 128/63 |
| 2,349,743 | 5/1944 | Meyer | 128/32 |

*Primary Examiner*—Lawrence W. Trapp

*Attorney, Agent, or Firm*—Karl F. Ross; Herbert Dubno

[57] ABSTRACT

A vibratory massage apparatus comprises a frame from which is suspended a pair of rings lying in a vertical plane and at a height allowing a person to hang by his hands freely from the rings. Each of these rings is carried in a respective rider that is mounted on an eccentric disc carried on a common horizontal shaft of a motor. The disks are offset by 180° to each other so that as the motor shaft rotates the one ring goes up and the other down and vice versa. A crosspiece at the lower region of the frame may be used to aid the person to step up and grasp the rings, and more than one such crosspiece may be provided in order to facilitate certain types of exercises.

10 Claims, 5 Drawing Figures

FIG. 3A
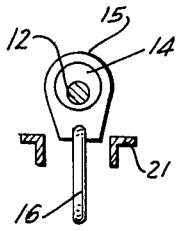
FIG. 3B
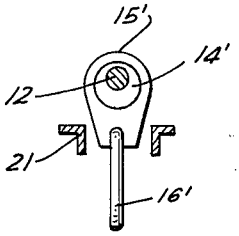
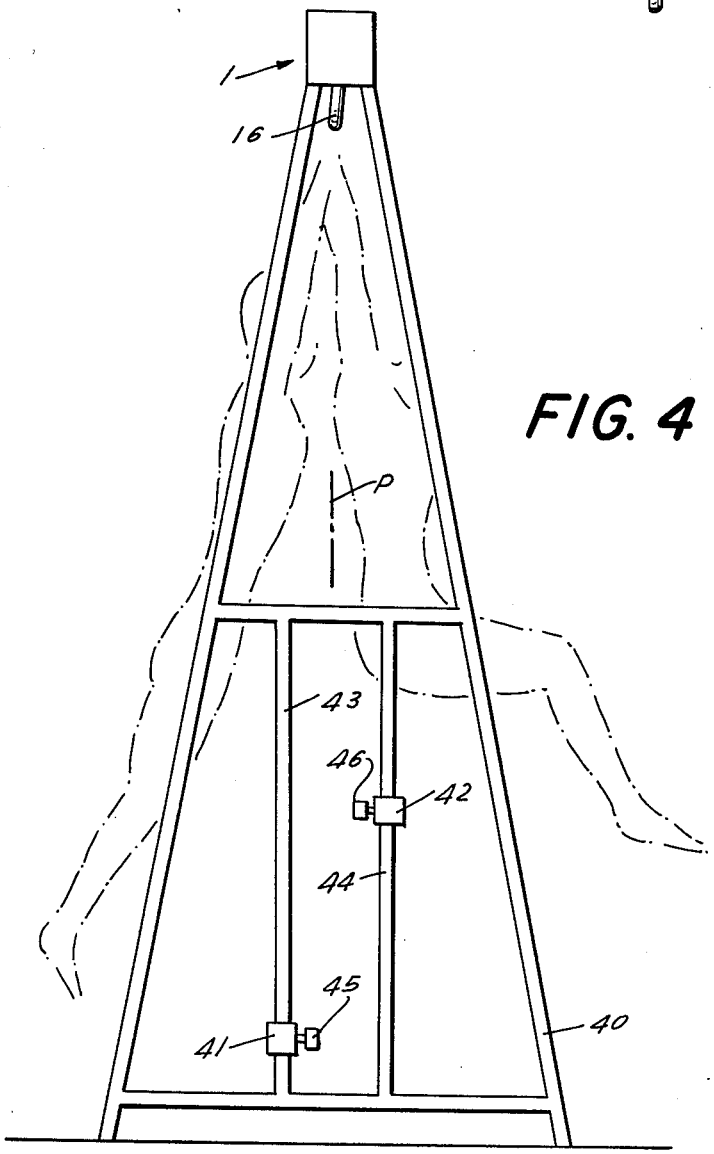
FIG. 4

VIBRATORY MASSAGE APPARATUS

FIELD OF THE INVENTION

The present invention relates to a vibratory massage device. More particularly this invention concerns such a device usable to treat back and shoulder problems of a muscular or rheumatic nature.

BACKGROUND OF THE INVENTION

Vibratory massage devices are known for treating muscle cramps, lumbago, and the like by vibrating the afflicted region of a person suffering from such a problem. Typically such a device is formed of a wide belt that is looped around a person and oscillated rapidly. Such an arrangement has only limited effect and is almost useless for treating serious back problems. The only other type of device of any commercial success is a hand-held vibrator which is applied to the afflicted region. Such a device has the disadvantage that it requires a skilled operator to use it and is only effective for a limited anatomical region.

OBJECTS OF THE INVENTION

It is therefore an object of the present invention to provide an improved vibratory massage apparatus.

Yet another object is the provision of such an apparatus which can be used alone, that is without the help of other persons.

Yet another object is the provision of such a device which is useful in vibratory treating back ailments such as lumbago.

SUMMARY OF THE INVENTION

These objects are attained according to the present invention in a device having a pair of hand grips which are suspended in an overhead position allowing a person to hand free by his hands from the grips. Means is provided for rapidly vertically reciprocating the grips with sufficient force to vibrate the person having by his hands.

Such an arrangement has proven extremely effective for treating major back ailments, as the vertical vibrations are very effective for loosening up muscular cramps without straining the person using the device. The vibration imparted by this arrangement has been found to be exceptionally soothing and effective for the treatment of relatively extensive muscular and rheumatic aches and pains.

According to further features of this invention the rings are suspended from a frame and each ring is carried on a rider mounted on a respective eccentric disk. Both of the disks are carried on a common horizontal motor shaft that is rotated at a speed between 500 and 1000 RPM. The one eccentric is offset by between 130° and 230°, preferably 180°, from the other so that as the one ring goes up the other goes down and vice versa. This alternating action has been found to be extremely effective.

In accordance with further features of this invention, the frame is provided with at least one cross member spaced below the rings at a distance allowing the user to use it as a step to attain a sufficiently elevated position to grasp the rings. More than one such cross member may be provided in order to facilitate various kinds of exercises on the vibration device, with one or both of the cross members being displaceable.

BRIEF DESCRIPTION OF THE DRAWING

The above and other objects, features, and advantages of the invention will become more readily apparent from the following description, reference being made to the accompanying drawing in which:

FIGS. 3A and 3B are sections taken through the upper portion of the apparatus shown in FIG. 1; and FIG. 4 is a side-elevational view of another apparatus in accordance with this invention.

SPECIFIC DESCRIPTION

Figure 1:
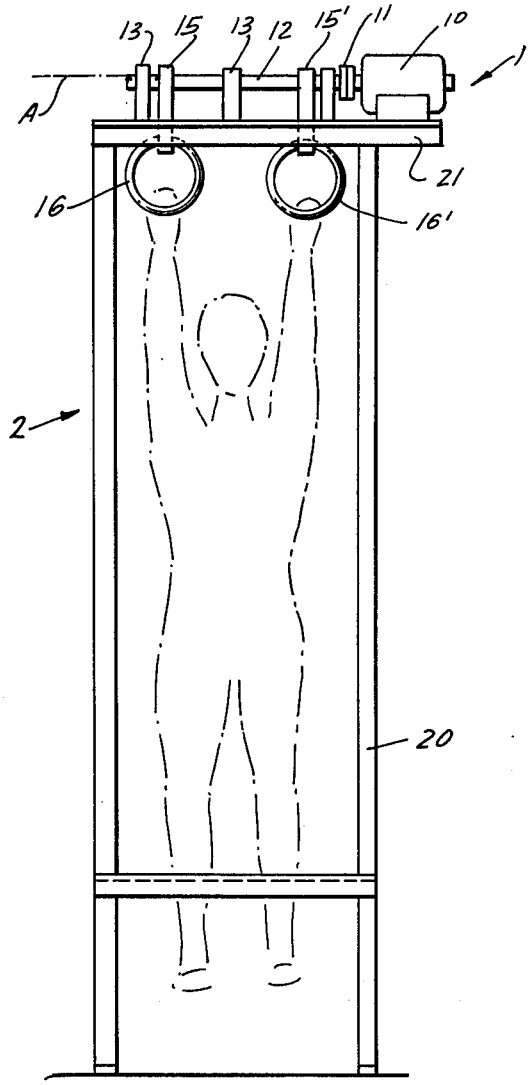
FIG. 1 is a front-elevational view of the apparatus according to the present invention.
Figure 2:
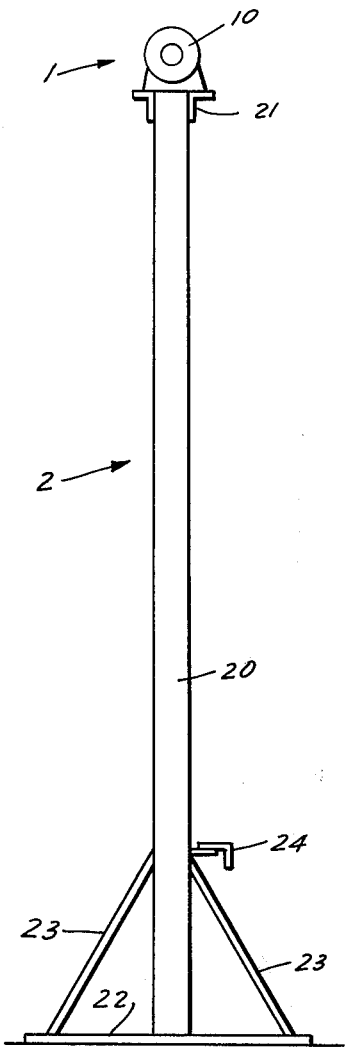
FIG. 2 is a side view of the apparatus shown in FIG. 1.

As shown in FIGS. 1, 2, 3A, and 3B the massage apparatus 1 according to the present invention is supported on a frame 2. This frame 2 comprises a pair of parallel vertical posts 20 extending upwardly from and secured to a flat rectangular base plate 22, with struts 23 making the assembly rigid. Approximately two feet off the ground there is provided a cross member 24 serving as a step and sufficiently strong to hold the weight of a person.

The apparatus 1 is supported on a pair of angle irons 21 extending horizontally parallel to each other between the upper ends of the posts 20. A motor 10 is supported on the one end of the angle irons 21 and is connected to a driveshaft 12 by means of a coupling 11. This driveshaft 12 is rotatable about its central axis A aid is mounted via heavy-duty bearings in three journal blocks 13 secured at the two ends and center of the shaft on the angle irons 21. As shown in FIGS. 3A and 3B the shaft 12 carries a pair of eccentric circular disks 14 and 14' offset by 180° to each other relative to the axis A of the shaft 12. These disks 14 and 14' fit within circular holes in riders 15 and 15' from which are suspended rings 16 and 16' that are spaced apart along the axis A by a distance of approximately eighteen inches. The rings 16 and 16' normally lie in a vertical plane including the axis A.

The person suffering from a back ailment such as lumbago uses the device by first turning on the motor. This vertically reciprocates the rings alternately to one another through a distance between ½ and 1 inch, the one ring going up while the other comes down and vice versa. The user then steps up via the crosspiece 24 and grips the rings 16 and 16', one in each hand. He then hangs free from these rings and allows the alternate vertical reciprocation of these rings to massage out cramps and the like. The motor 10 operates at a speed of 700 RPM, which has been found most effective for this type of hanging massage.

FIG. 4 shows another arrangement having an A-shaped frame 40 having a pair of upright members 43 and 44 lying offset from a plane P passing upwardly through the massage device 1 at the top of the frame 40. The uprights 43 to one side of this plane P carry a vertically displaceable cross member 41 securable by means of a clamping screw 45, and the members 44 carry another cross piece 42 itself securable by means of a clamping screw 46. With this arrangement the user steps up to grip the rings 16 and 16' by means of the lower cross member 41, and the cross member 42 is provided to allow him to do certain exercises such as indicated in FIG. 4. Thus he may swing back and forth with his legs passing over the upper cross member 42 so as to perform a very beneficial exercise and obtain a massage at the same time. The two crosspieces 41 and 42 can be adjusted for various kinds of exercises and for use of the apparatus by persons of different height. The device 1 can, of course, also be hung from a ceiling or door frame.

With the system according to the present invention it is possible for a person all alone to obtain a soothing massage. This device has been found extremely effective for muscular cramps and back ailments such as lumbago which respond readily to a vibration-type treatment.

I claim:

1. A vibratory massage apparatus comprising:

a pair of hand grips;

means for suspending said grips next to one another in an overhead position allowing a person to hang free by his hands from said grips; and drive means including a motor for vertically limitedly reciprocating said grips with sufficient force to vibrate a person hanging by his hands from said grips, said motor having a shaft carrying a pair of eccentrics, each of said grips being mounted on a respective eccentric.

2. The apparatus defined in claim 1, further comprising a frame adapted to stand on the ground and having an upper end carrying said grips.

3. The apparatus defined in claim 2 wherein said frame has a cross member spaced above the ground and below the grips by distances permitting a person to step up on said member and grasp said grips.

4. The apparatus defined in claim 3 wherein said member is vertically displaceable on said frame, said frame having means for locking said member in any of a plurality of vertically offset positions on said frame.

5. The apparatus defined in claim 1 wherein said shaft is horizontal and said eccentrics are offset by between 130° and 230° to each other relative to the axis of said shaft.

6. The apparatus defined in claim 5 wherein said eccentrics are offset by 180° to each other.

7. The apparatus defined in claim 1 wherein said eccentrics are circular disks and each grip has a rider formed with a circular hole surrounding the respective disk.

8. The apparatus defined in claim 1 wherein said motor rotates said shaft at a speed between 500 rpm and 1000 rpm.

9. The apparatus defined in claim 1 wherein said grips are rings normally lying in a common vertical plane.

10. A vibratory massage apparatus comprising:

a pair of hand grips;

means for suspending said grips next to one another in an overhead position allowing a person to hang free by his hands from said grips;

drive means including a motor for vertically limitedly reciprocating said grips with sufficient force to vibrate a person hanging by his hands from said grips;

a frame adapted to stand on the ground and having an upper end carrying said grips;

a cross member on said frame spaced above the ground and below the grips by distances permitting a person to step up on said member and grasp said grips, said member being vertically displaceable on said frame; and means on said frame for locking said member in any of a plurality of vertically offset positions on said frame.

* * * * *